US011851840B1

(12) United States Patent
Sinclair

(10) Patent No.: US 11,851,840 B1
(45) Date of Patent: Dec. 26, 2023

(54) COUPLING FOR DRIVEN STEEL PIPE PILES AND METHOD OF MANUFACTURING SAME

(71) Applicant: JOHN LAWRIE, INC., Houston, TX (US)

(72) Inventor: Victor Arthur Sinclair, Houston, TX (US)

(73) Assignee: John Lawrie, Inc., Houston, TX (US)

( * ) Notice: Subject to any disclaimer, the term of this patent is extended or adjusted under 35 U.S.C. 154(b) by 0 days.

(21) Appl. No.: 18/100,355

(22) Filed: Jan. 23, 2023

(30) Foreign Application Priority Data

Dec. 15, 2022 (CA) ..... CA 3184038

(51) Int. Cl.
*F16L 13/16* (2006.01)
*F16L 13/14* (2006.01)
(Continued)

(52) U.S. Cl.
CPC ..... *E02D 5/285* (2013.01); *E02D 5/48* (2013.01); *E02D 2200/1685* (2013.01);
(Continued)

(58) Field of Classification Search
CPC ..... E02D 5/285; E02D 5/48; E02D 5/526; E02D 2600/20; E02D 2200/1685;
(Continued)

(56) References Cited

U.S. PATENT DOCUMENTS 964,052 A * 7/1910 Pflugh ..... F16L 13/146 29/520
1,886,275 A * 11/1932 Bernhardt ..... F16L 13/04 285/382.4
(Continued)

FOREIGN PATENT DOCUMENTS

CN 111021352 A 4/2020
GB 2397327 A 7/2004

OTHER PUBLICATIONS

Hubbell; Chance® Combination (SS-RS) Helical Cast Transition, Geoengineer.org | The International Information Center for Geotechnical Engineers and related fields; downloaded Oct. 17, 2022 from https://www.geoengineer.org/news/hubbell-chance-combination-ss-rs-helical-cast-transition, 4 pages.
Magnum Piering; Helical Piers: Back to Basics, May 22, 2019; downloaded Oct. 17, 2022 from https://www.magnumpiering.com/2019/05/22/helical-piers-back-to-basics/, 4 pages.
(Continued)

*Primary Examiner* — Amber R Anderson
*Assistant Examiner* — Stacy N Lawson
(74) *Attorney, Agent, or Firm* — Wells St. John P.S.

(57) ABSTRACT

A coupling between lead and extension pile segments of a driven piling. The extension segment has a formed end, an opposite driven end and a body extending therebetween. The formed end has an inner diameter equal to an outer diameter of an exposed end of the lead segment and greater than an outer diameter of the extension segment's body. The formed end has an initial length prior to coupling the extension and lead segments; the formed end undergoes secondary end forming when a driving force is applied, such that the formed end has a final length exceeding the initial length after the extension and lead segments are coupled. In some embodiments, the extension segment has an external ring portion positioned upstream of the formed end, and the exposed end of the lead segment is cold extruded into and through the external ring portion of the extension segment.

13 Claims, 7 Drawing Sheets

(51) Int. Cl.
*B21D 39/04* (2006.01)
*E02D 5/28* (2006.01)
*E02D 5/48* (2006.01)

(52) U.S. Cl.
CPC ..... *E02D 2250/0015* (2013.01); *E02D 2300/0029* (2013.01); *E02D 2600/20* (2013.01)

(58) Field of Classification Search
CPC .... E02D 2250/0015; E02D 2300/0029; E04H 12/2269; F16L 13/14; F16L 13/141; F16L 13/146; F16L 13/147; F16L 13/16; B21D 39/04
USPC ..... 285/382, 382.4, 382.5
See application file for complete search history.

(56) References Cited

U.S. PATENT DOCUMENTS

| | | | | | |
|---|---|---|---|---|---|
| 3,466,738 | A * | 9/1969 | Mount | B21D 39/04 | 29/237 |
| 4,569,617 | A * | 2/1986 | Schmidt | E02D 5/523 | 285/332 |
| 4,588,215 | A * | 5/1986 | Moxham | B21D 39/04 | 285/94 |
| 4,645,247 | A * | 2/1987 | Ward | B21D 39/04 | 285/382.4 |
| 4,769,897 | A * | 9/1988 | Moseman | F16L 13/14 | 29/525 |
| 9,593,458 | B2 | 3/2017 | Satlow | | |
| 9,631,768 | B1 | 4/2017 | Cote | | |
| 2008/0063479 | A1 | 3/2008 | Stroyer | | |
| 2008/0317556 | A1 | 12/2008 | Price | | |
| 2016/0160466 | A1* | 6/2016 | Satlow | E02D 5/24 | 405/251 |
| 2019/0127940 | A1 | 5/2019 | Kaufman et al. | | |

OTHER PUBLICATIONS

Screwfast Foundations; Helical Piling; downloaded Oct. 17, 2022 from https://www.screwfast.com/foundation-solutions/helical-pile/, 8 pages.
Pile King; Helical Piles & Their Uses; downloaded Oct. 17, 2022 from https://pileking.net/helical-piles/, 7 pages.
Helical Pile; Versatile Steel Pile & Anchor System—E102-brochureHPA.01-00; downloaded Oct. 17, 2022 from https://helicalpile.asia/, 3 pages.
M&D Foundations; Steel Cased; downloaded Oct. 17, 2022 from https://mdfoundations.com/services/driven-piling/steel-cased/, 6 pages.
Sarl Coulon Pieux Battus; Driven Ductile Cast Iron Piles; downloaded Oct. 17, 2022 from https://mdfoundations.com/services/driven-piling/steel-cased/, 16 pages.
Chance Foundation Solutions; 2.875" Round Shaft Helical Extension(RS2875.203), 14 × 5ft, Catalog ID: C2784501CU; downloaded Oct. 17, 2022 from https://www.hubbell.com/chancefoundationsolutions/en/Products/Power-Utilities/Anchoring-Foundations/Helical-Anchors-Piles/Extensions/2-875-Round-Shaft-Helical-ExtensionRS2875-203-14-x-5ft/p/2699253, 2 pages.
Chance Civil Construction; Design, Installation and Testing of Helical Piles & Anchors, presented by: Donald A. Deardorff, P.E., Centralia, MO, USA; downloaded Oct. 17, 2022 from http://www.foundationperformance.org/pastpresentations/DeardorffPresSlides-8Apr09.pdf, 89 pages.
Foundation Supportworks; Helical Piles and Anchors Hydraulically Driven Push Piers Polyurethane Injection Supplemental Support Systems—FSI Technical Manual, Second Edition Jul. 2014; downloaded Mar. 23, 2023 from https://commercial.foundationsupportworks.com/core/images/universal /fsi-tech-10-16/files/assets/common/downloads/publication.pdf, 372 pages.
Chance Civil Construction; Foundations & Installing Tools for Transmission & Substations Catalog 4B Jul. 2017; downloaded Oct. 17, 2022 from https://hubbellcdn.com/catalogfull/04B-UtilityFoundations.pdf, 34 pages.
Imeco Austria; Ductile Iron Driven Piles; downloaded Oct. 17, 2022 from https://www.imeco.at/index.php?id=pil19, 1 page.
Soil Testing, Inc.; What Is Construction Piling?; Sep. 27, 2016, downloaded Oct. 17, 2022 from https://www.soiltestinginc.net/2016/09/construction-piling/, 3 pages.
Surefoot; Concrete Free Footing System brochure—downloaded Oct. 18, 2022 from https://surefootfootings.com.au/wp-content/uploads/2022/08/SUREFOOT-BROCHURE-low-res-1.pdf, 8 pages.
Substruck Ltd.; Driven Piles; downloaded Oct. 18, 2022 from https://substruck.ie/our-services/ground-engineering/driven-piles/, 5 pages.
Kuhn et al.; Opti-OWECS Final Report vol. 2: Methods Assisting the Design of Offshore Wind Energy Conversion Systems; Jan. 1998, downloaded Oct. 18, 2022 from https://www.researchgate.net/profile/Gerard-Van-Bussel/publication/266455954_Opti-OWECS_Final_Report_Vol_2_Methods_Assisting_the_Design_of_Offshore_Wind_Energy_Conversion_Systems/links/54bcf20e0cf253b50e2d8729/Opti-OWECS-Final-Report-Vol-2-Methods-Assisting-the-Design-of-Offshore-Wind-Energy-Conversion-Systems.pdf, 197 pages.
Michael Tomlinson & John Woodward; Pile Design and Construction Practice (Fifth Edition); downloaded Oct. 18, 2022 from https://menglim498.files.wordpress.com/2013/04/pile-design-and-construction.pdf, 564 pages.
Baert; Master Thesis—Analysis of the Installation of a Series of Piles for Offshore Wind Turbine Foundations, developed at University of Rostock in the framework of the "EMSHIP" Erasmus Mundus Master Course in "Integrated Advanced Ship Design", Feb. 2014; downloaded Mar. 20, 2023 from https://matheo.uliege.be/bitstream/2268.2/6136/1/BAERT%20%20Benjamin%20-%20%20URO%20%28Public%20Version%2C%20Feb%202014.pdf, 78 pages.
Sustatxa; Cost Analysis of Offshore Wind Turbine Support Structures, Monopile and Jacket—Thesis presented in fulfilment of the requirements for the degree of Master of Philosophy 2011, University of Strathclyde, Naval Architecture and Marine Engineering Department, downloaded Mar. 21, 2023 from https://stax.strath.ac.uk/concern/theses/47429913s?locale=en, 137 pages.
Clarke et al.; Development of a Swaged Pile/Sleeve Connection System for Application on a North Sea Jacket, Paper presented at the Offshore Technology Conference, Houston, Texas, May 1988. Paper No. OTC-5772-MS; https://doi.org/10.4043/5772-MS; Published: May 2, 1988; downloaded Mar. 21, 2023 from https://onepetro.org/OTCONF/proceedings-abstract/88OTC/All-88OTC/OTC-5772-MS/49533, 6 pages.
Scira Offshore Energy Ltd.; Environmental Statement, May 2006; downloaded Mar. 21, 2023 from http://sheringhamshoal.co.uk/downloads/Offshore%20environmental%20statement.pdf, 722 pages.
Van Gerven; Optimizing the Design of a Steel Substructure for Offshore Wind Turbines in Deeper Waters, Oct. 14, 2011, MSc Thesis—Delft University of Technology Faculty of Civil Engineering and Geosciences; downloaded Mar. 21, 2023 from https://repository.tudelft.nl/islandora/object/uuid%3Ad795483c-2255-4ad9-8295-79c134ca1e17, 183 pages.
Chance Civil Construction | Hubbell Power Systems, Inc.; Chance Technical Design Manual | Edition 4, Bulletin 01-0605/Revision Dec. 2018; downloaded on Mar. 27, 2023 from Wayback Machine https://web.archive.org/web/20220324000624/ https://hubbellcdn.com/catalogfull/CHANCE%20Technical%20Design%20Manual.pdf, 448 pages.

* cited by examiner

COUPLING FOR DRIVEN STEEL PIPE PILES AND METHOD OF MANUFACTURING SAME

This application claims priority to CA Patent Application Serial No. 3,184,038, which was filed Dec. 15, 2022, the teachings of which are incorporated herein by reference.

FIELD

The present disclosure relates to driven steel pipe piles; in particular, the disclosure relates to couplings for coupling together steel pipe pile segments.

BACKGROUND

Driven steel pipe piles are large metal pipes or tubes that are driven into the ground. Typical piles may have a circular cross-section, and they come in segments of different lengths. In a given application, it may be required to drive multiple pile segments into the ground to achieve a desired piling depth that provides sufficient anchoring and stability for a building or other type of construction. When two or more pile segments are used, they are coupled together.

As the terms are used herein, a segment of pipe pile that is installed in the ground, with one end of the segment extending out of the ground (herein, referred to as an exposed end) for coupling to a subsequent segment, is called the lead pile (or lead pile segment). A subsequent segment of pipe pile added to the lead pile installed in the ground is called an extension pile (or extension pile segment). For the avoidance of doubt, as the terms are used herein, a first segment installed into the ground is called a lead segment, and a second segment that is added to that first segment is called an extension segment. After the second segment is coupled to the first segment and driven into the ground until only a short length of the second segment extends above the ground, the second segment is called the "lead segment" and the third segment, to be coupled to the second segment, is called the "extension segment", when coupling the third segment to the second segment that is installed in the ground. A coupling method is required for each extension pile segment that is added to a lead pile segment. The above-described terms for lead and extension piles (or otherwise referred to herein as pile segments) are used interchangeably throughout the present disclosure.

When coupling two pile segments of a driven pile, the coupling may need to resist lateral forces to achieve a straight, linear pile, as any bends or deflection of the pile underground may reduce the overall strength of the pile. Couplings which do not provide sufficient resistance to lateral forces may be subject to buckling or breakage during the installation process. Furthermore, the coupling between two driven pile segments may, in some applications, need to resist tension forces so that the coupled pile segments do not pull apart when an upward force is applied by the load at the uppermost connection to the pile. Once installed, the driven pile must be able to resist compressive, bending moment (lateral), and tension loads that may be applied to the top of the pile by the structure that is connected to the pile.

There are several conventional methods for coupling together segments of driven piles. One method involves welding two pile segments together, as illustrated in FIG. 1A. This requires the exposed end 32 of the lead pile segment 30, driven into the ground, to be prepared for welding in the field. To prepare the exposed end 32 of the lead pile segment for welding, it is often necessary to cut off a portion of the exposed end to remove damage caused by the driving hammer. The exposed end of the lead pile may then be beveled to provide one half of the fillet required for welding to an end 21 of the extension pile segment. The extension pile segment 20 may be provided with a beveled edge, to eliminate the need to prepare this beveled edge in the field. A backing ring 2 is typically tack welded into the interior surface of the exposed end 32 of the lead pile, in the field, to provide a backing surface so that the weld does not blow through the inside wall of the pile. The extension pile segment 20 is then suspended in the air and positioned above the lead pile segment 30 by the pile rig, and then aligned with and placed on top of the exposed end 32 of the lead pile segment 30, which has the backing ring 2 installed. The pile rig then holds the extension pile segment 20 in place while the two pile segments are welded together in the field. Using the pile rig (otherwise referred to herein as a pile rig) to hold the extension pile segment 20 in place during the welding process may be costly, as the pile rig cannot be used to drive other piles into the ground until the welding is completed. In some cases, the extension pile may be initially tacked onto the lead pile, at which point the pile rig may safely release the upper end of the extension pile segment so that the pile rig may move away from that pile and work on other installations while the welding job is completed. However, in this case the pile rig would still travel back to this pile and reposition, once the welding is complete and driving is ready to resume. Such travel and repositioning also results in time where the pile rig is not installing piles, which may add to the overall cost of the project.

Another known method of coupling together two pile segments is to use a welded fit splice sleeve, as illustrated in FIG. 1B. This method uses a fabricated steel or cast steel sleeve 50 that has an inner diameter on both ends of the sleeve that is larger than the outer diameter of both the lead and extension pile segments, so that the exposed end of the lead pile segment and an end 21 of the extension pile segment may each be fitted into the opposite ends of the sleeve 50. The sleeve also includes an interior ledge 52 that extends from an interior wall of the sleeve 50, so that each of the ends 32, 21 of the lead and extension pile segments stop against the ledge 52. Typically, the sleeve 50 is firstly welded to an end 21 of the extension pile segment off-site to reduce field welding costs. When it is time to add the extension pile segment 21, the exposed end 32 of the lead pile segment may need to be trimmed off, to remove damage caused by the driving hammer. The extension pile segment 20, with the sleeve 50 welded on, is then suspended by the pile rig above the exposed end of the lead pile segment so that the sleeve 50 at the end of the extension pile segment is aligned with and fitted over the exposed end of the lead segment. The pile rig suspends the extension pile segment in place while the bottom portion of the sleeve is welded, in the field, to the lead pile segment. Depending on the inner diameter of the sleeve 50, a gap 4 may result between the outer wall of the pile segment and the inner wall 51 of the sleeve. If this gap 4 is too large, a hinge point may be created such that lateral force resistance is diminished, resulting in movement of the pile laterally at the ground level and potentially resulting in pile instability. As a result, the structure loaded onto a pile that is coupled together using this method, may have lateral movement that exceeds what the design specification allows.

Another type of coupling is a drive fit splice sleeve, as illustrated in FIG. 1C. Similar to the welded fit splice sleeve described with reference to FIG. 1B, a drive fit splice sleeve 60 has an inner diameter on both ends of the sleeve that is larger than the outer diameter of both the lead and extension pile segments, so that the exposed end 32 of the lead pile segment and an end 21 of the extension pile segment may each be fitted into the opposite ends of the sleeve 60. However, the inner walls 61 of this sleeve 60 are tapered inwardly at both ends, extending towards a ledge 62, so that the inner diameter decreases towards the ledge 62 at both ends of the sleeve 60. The inner diameter of the sleeve 60, proximate the ledge 62, is smaller than the outer diameter of the pile segment that is being inserted into the sleeve. To install this type of coupling, the sleeve 60 is typically placed over the exposed end of the lead pile segment and is manually hammered to engage the tapered interior wall 61 with the exposed end of the lead pile, setting the sleeve in line with a central axis of the lead pile segment. Then, the pile rig positions and inserts the extension pile segment 20 into the opposite end of the sleeve 60. Once the end 21 of the extension pile segment 20 is inserted into the sleeve 60, the pile rig applies a driving force to the driven end of the extension pile segment to drive the opposite end of the extension pile segment deeper into the tapered section of the sleeve 60 until the respective ends of each pile segment abuts against the ledge 62 within the sleeve 60. Although this coupling method does not require field welding, this coupling method does not provide tension resistance and therefore the extension pile segment may pull out of the sleeve if an upward force is applied. Additionally, the coupling sleeve may be difficult to align with the ends of the pile segments, and if misalignment occurs it may cause a slight curve in the installed pile underground. Furthermore, the short depth of the coupler and the lack of welding may create a hinge point that does not resist lateral loads applied to the top end of the pile, resulting in excessive lateral movement at the top of the pile.

A further coupling method utilizes a prefabricated rebar cage that is inserted inside the exposed end of the lead pile segment, and an opposite end of the rebar cage extends out of the exposed end of the lead pile segment. Then, the extension pile segment is lifted into place by the pile rig and fitted over the protruding end of the rebar cage. The rebar cage aligns the two ends of the pile segments to be coupled, while the extension pile segment is driven into the ground by the pile rig. The rebar cage includes small tabs, or a tube section attached to the rebar cage, which sits on top of the exposed end of the lead pile segment to prevent the rebar cage from falling into the lead pile segment. These tabs create a small gap between the two coupled pile segments. In most cases, this coupling method requires the installation of concrete inside the extension pile segment to solidify the coupling of the two pile segments. The rebar cage, on its own, does not provide any tension force resistance or lateral force resistance. The addition of the concrete increases the overall cost of installation and may be time consuming.

Another coupling method involves a ductile iron pipe spigot and socket system. This consists of cast ductile iron pipe segments that have a spigot opening at one end and a socket opening at the opposite end. The lead pile segment includes a socket at the exposed end of the pile. When an extension needs to be added, the spigot end of the extension pile segment is inserted into the socket end of the lead pile segment. The socket end includes a slight taper on the inner walls extending towards an inner ledge, and the spigot end of the extension pile segment abuts against this ledge during insertion. This tapered coupling method couples the two pile segments together, but does not provide any tension resistance, unless some form of reinforcement is added to the pile, such as concrete, grout, tension cables or rods. Therefore, the extension pile segment will pull out of the lead pile segment if an upward force is applied, in the absence of adding any reinforcement to the installed pile. The relatively short depth of the coupling and the lack of welding create a hinge point that does not resist lateral loads applied to the upper end of the pile segment, resulting in excessive lateral movement of the top of the pile. Furthermore, the pre-cast piles, including the spigot and socket ends, are typically more expensive to manufacture as compared to structural pipe typically used for piles. For applications requiring tension resistance, there is a significant additional cost of adding reinforcement to the pile (such as concrete, steel cables, etc.). As well, the Applicant has found that the lead and extension pile segments featuring the spigot and socket ends are limited in length, requiring more segments and more couplings to reach the desired pile depths, which may thereby increase the cost of the final installed pile. Additionally, ductile iron is difficult to weld, and welding ductile iron may result in weld stress and cracking that occurs during welding or cooling. As a result, this coupling method may not be capable of providing full tension load resistance.

Applicant is also aware of U.S. Pat. No. 9,593,458 to Tiroler Rohre GmbH (the "'458 patent"). The '458 patent describes a driven pile comprising a substantially cylindrical shaft, the shaft having first and second pile ends, and a socket that is arranged on the driven pile in the region of the second pile end. The socket or the driven pile has an abutment in the region of the second pile end, so that a further driven pile may be inserted with a first pile end as far as a maximum insertion depth defined by the abutment. The socket and/or the driven pile in the region of the second pile end provides at least one undercut portion extending at least substantially to the abutment. The first pile end inserted into the socket deforms while being driven, conforming to the undercut portion of the socket in the region of the abutment when a driving force is applied. Although this coupling method couples the two pile segments together, it is the Applicant's opinion that this coupling method provides a limited or no level of tension load resistance, and that the extension pile segment may pull out of the lead pile segment if a tension load is applied to the pile. Additionally, in the Applicant's view, the relatively short depth of the coupling and the lack of welding may create a hinge point that offers minimal or no resistance to lateral loads applied to the upper end of the pile segment, which may result in excessive lateral movement of the top of the installed pile.

It is desirable to have a relatively quick and inexpensive method for coupling together pile segments in the field, providing a strong and inexpensive coupling that resists not only compressive loads, but also lateral (bending moment) forces and/or tension forces, with minimal or no field welding.

SUMMARY

In one aspect of the present disclosure, Applicant has discovered that manufacturing pile segments having a cylindrical body and one formed end, the formed end having a diameter that is greater than the diameter of the cylindrical body, provides for a relatively inexpensive coupling between two driven pile segments which may be relatively quickly and inexpensively installed in the field, as compared to other known coupling methods. Furthermore, the Applicant has found that this relatively simple and inexpensive coupling method allows for flexibility in designing a pile that meets different specification requirements for resistance to compression, lateral, and/or tension forces.

In one embodiment, the formed end of each pile segment has a substantially uniform diameter along the length of the formed end, without any tapering of the inner or outer walls of the formed end. In use, an exposed end of the lead pile segment has an outer diameter which is equal to or smaller than the inner diameter of the formed end of the extension pile segment. The formed end of the extension pile segment is sized to snugly fit over the exposed end of the lead pile segment. To couple the extension pile segment to the lead pile segment, the formed end is aligned over the exposed end of the lead pile segment, and then a driving force is applied to the driven end of the extension pile segment to push the formed end over the exposed end of the lead pile segment. Applying a sufficient amount of driving force to the extension pile segment causes the lead pile segment to extend further into the extension pile segment, beyond the length of the formed end of the extension pile segment, which produces secondary end forming to extend the initial length of the formed end. The secondary end forming process increases the friction between the coupled pile segments, providing some tension resistance to the coupling relative to the amount of driving force that is applied to the coupled pile segments. As the driving force continues to be applied to the extension segment, the extended pile is further driven into the ground.

In some embodiments, the extension pile segment further includes an external ring portion that is positioned upstream of the formed end of the extension pile segment. In some embodiments, the external ring portion abuts against the formed end, which prevents the secondary end forming process from occurring when the extension pile segment is driven onto the lead pile segment. Instead, the Applicant has found that the exposed end of the lead pile segment is cold extruded through the external ring portion of the extension pile segment when sufficient magnitude of driving force is applied, without expanding the outer diameter of the external ring portion. Advantageously, the Applicant has found that this cold extrusion process provides for a tight coupling that provides greater resistance to tension and lateral forces.

In another embodiment, the external ring portion of the extension pile segment is spaced apart from, and upstream of, the formed end of the extension pile segment. When the driving force is applied to the driven end of the extension pile segment, the final length of the formed end that results from the secondary end forming process is limited by the position of the external ring portion, such that the formed end abuts against the external ring portion as the driving force is applied. Furthermore, the exposed end of the lead pile segment, once it has reached the external ring portion, may also be cold extruded into and through the external ring portion of the extension pile segment when a sufficient magnitude of driving force is applied, thereby increasing the tension and lateral resistance of the coupling.

In the different embodiments disclosed herein, the formed end has a substantially consistent diameter throughout the length of the formed end, and the inner and outer diameters of the formed end are greater than the diameter of the rest of the cylindrical body of the pile segment, thereby providing a pile segment with a widened end or opening. Although the pile segment having a widened end may be formed by any number of manufacturing methods known to a person skilled in the art, in a preferred method of manufacturing, the formed end is manufactured by taking an existing structural pipe and forming the widened end using a hot or cold end forming machine, such that a specially designed mandrel having the desired diameter for the widened end is pushed by force into the end of the pipe that is to be widened, until the desired formed end, having a desired formed end length and diameter, is created. This manufacturing process is relatively inexpensive, and produces the desired piling end having a widened, formed end. This method of manufacturing may be performed on recycled or recovered pipes, thereby further reducing the overall cost while conserving energy and materials. The mandrel tooling requires a specific design for each diameter required at the formed end. Knowledge of the steel material properties is required to determine the correct mandrel diameter to compensate for the natural elastic spring-back of the steel pipe after the mandrel is removed. For example, a ramp may be provided at the end of the mandrel to overcome excessive spring-back of the steel, which spring-back force during the end forming procedure may result in a cupping of the formed end, rather than producing a formed end having a substantially consistent outer diameter through the length of the formed end.

The Applicant has found there is a direct relationship between the magnitude of the pile rig hammer impact energy on the pile and couplings, and the resulting working loading on the pile for tension and compression forces. Thus, an increased pile rig hammer impact energy, applied to the pile during installation using the coupling methods described herein that results in secondary end forming and/or cold extrusion of the exposed end of the lead pile through the external ring portion of the extension pile (as may be applicable), provides a correspondingly increased working loading on the installed pile for tension and compression forces.

In one aspect of the present disclosure, a coupling between a lead pile segment and an extension pile segment of a driven piling is provided. The extension pile segment has a formed end, an opposite driven end opposite of the formed end, and a body extending therebetween. The formed end has an inner diameter that is equal to or greater than an outer diameter of an exposed end of the lead pile segment and is greater than an outer diameter of the body of the extension pile segment, the formed end having an initial length prior to coupling the extension pile segment with the lead pile segment. The formed end of the extension pile segment undergoes secondary end forming when a driving force is applied to the driven end of the extension pile segment, such that the formed end has a final length exceeding the initial length after the driving force is applied to the driven end to couple the extension pile segment to the lead pile segment. In some embodiments, the initial length of the formed end is in the range of six inches to twelve inches.

In some embodiments, the extension pile segment also includes an external ring portion positioned upstream of the formed end of the extension pile segment, and the exposed end of the lead pile segment is cold extruded into and through the external ring portion of the extension pile segment to further increase a force resistance of the coupling. The external ring portion may include a ring, the ring having an inner diameter sized to snugly fit over the outer diameter of the body of the extension pile segment. In such embodiments, the ring may be welded to an exterior surface of the body of the extension pile segment. In other embodiments, the external ring portion may be fastened to an exterior surface of the extension pile segment, using a plurality of fasteners. In still other embodiments, the external ring portion may be integrally formed with an exterior surface of the body of the extension pile segment. The external ring portion may have a ring length in the range of three inches to six inches.

In some embodiments of the coupling, the external ring portion is adjacent to and abuts against the formed end of the extension pile segment. In other embodiments, the external ring portion is spaced apart from, and upstream of, the formed end of the extension pile segment at a selected distance. In such embodiments, when the driving force is applied to the driven end of the extension pile segment, the final length of the formed end that results from the secondary end forming process is equal to an initial length of the formed end and the selected distance between the formed end and the external ring portion.

In another aspect of the present disclosure, a method of manufacturing the extension pile segment of the pile coupling includes the steps of: a) selecting a structural pipe having a cylindrical body and an outer diameter; b) placing the structural pipe in an end forming machine, the end forming machine having a cylindrical mandrel with an outer diameter that is greater than the outer diameter of the cylindrical body; and c) performing an end forming procedure on a first end of the structural pipe to obtain a formed end of a selected length. The method may further include manufacturing an external ring portion on an exterior surface of the cylindrical body and upstream of the formed end, the external ring portion having an outer diameter that is greater than the outer diameter of the cylindrical body. In some embodiments, the step of manufacturing the external ring portion on the external surface of the cylindrical body includes affixing a ring to the exterior surface of the cylindrical body, wherein affixing the ring is selected from a group comprising: welding the ring, fastening the ring with a plurality of fasteners. In other embodiments, the step of manufacturing the external ring portion on the exterior surface of the cylindrical body includes integrally forming the external ring portion on the exterior surface of the cylindrical body such that the external ring portion has a wall thickness that exceeds a wall thickness of the cylindrical body adjacent to the external ring portion. The external ring portion may be positioned to abut against the formed end, or the external ring portion may be positioned spaced apart from, and upstream of, the formed end at a selected distance. The selected distance, in some embodiments, may be in the range between six and twelve inches. In some embodiments, the method may include the step of heating the first end of the structural pipe.

DETAILED DESCRIPTION

Figure 2A:
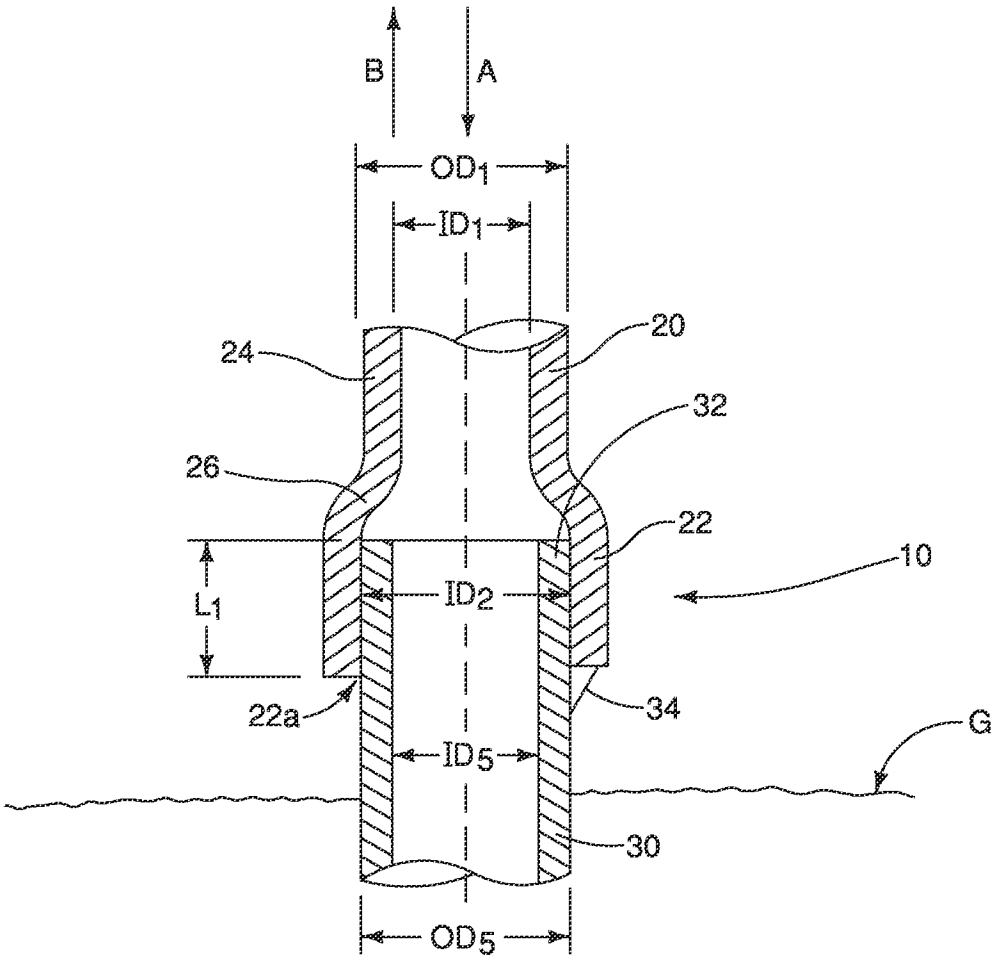
FIG. 2A is a sectional view of an embodiment of a pile coupling, wherein an extension pile segment includes a formed end.
Figure 2B:
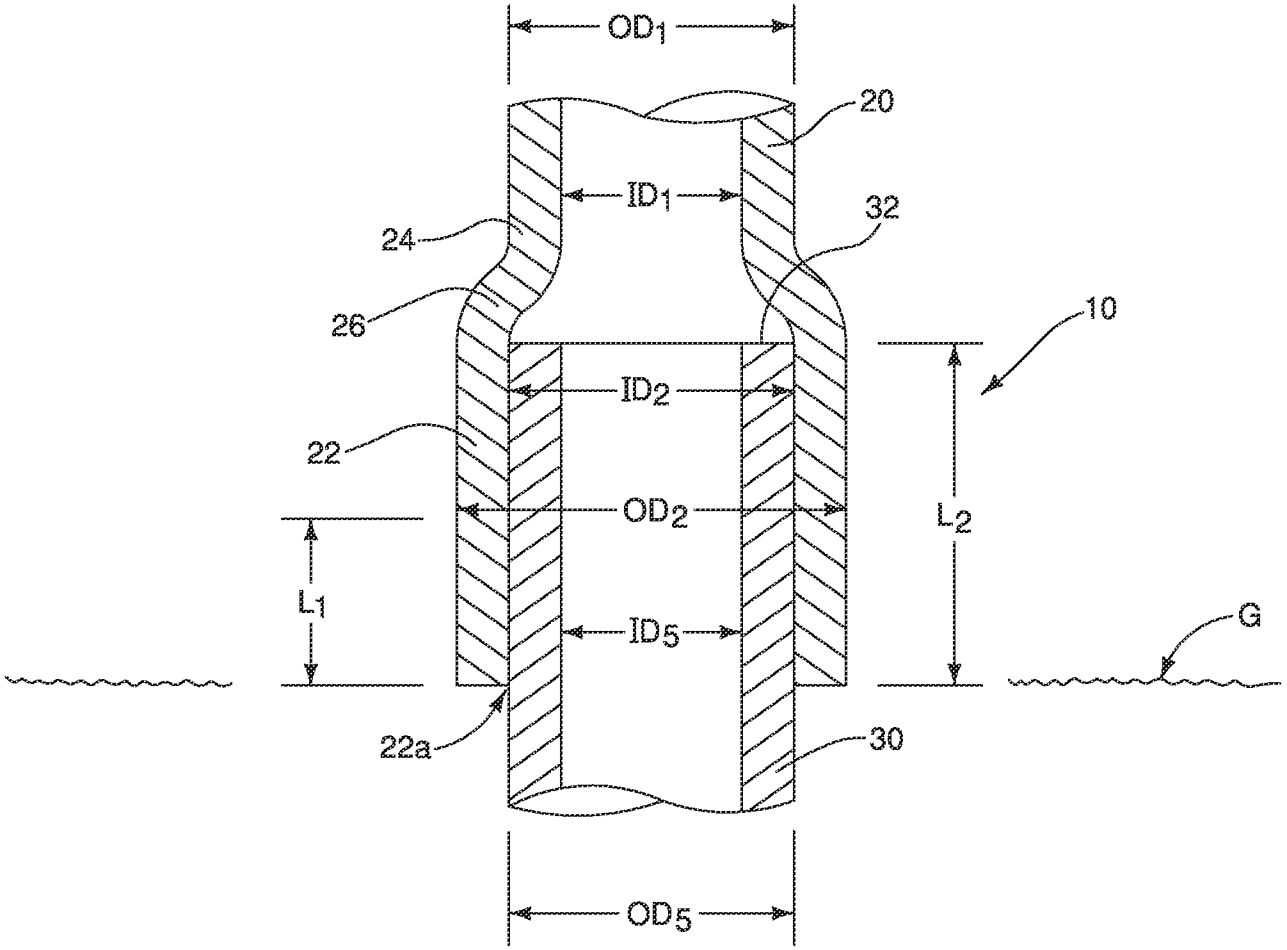
FIG. 2B is a sectional view of the embodiment of a pile coupling illustrated in FIG. 2A, where application of a driving force to the extension pile segment has resulted in secondary end forming of the extension pile segment.

As shown in FIGS. 2A and 2B, an embodiment of the pile coupling of the present disclosure comprises an extension pile segment 20 having a formed end 22. The formed end 22 has a widened opening 22*a* that is preferably sized to snugly fit over the exposed end 32 of the lead pile segment 30 that has already been driven into the ground G, with the exposed end 32 protruding from the ground G. The extension pile segment 20 and the lead pile segment 30 may be constructed of bare pipe or galvanized pipe, with the galvanized pipe having a thick coating on the pipe. The formed end 22 of the extension pile segment as an inner diameter ID2 that is approximately equal to the outer diameter OD5 of the lead pile segment 30 and greater than the inner diameter ID1 of the body 24 of the extension pile 20. The formed end 22 also has an outer diameter OD2. The inner diameter ID2 of formed end 22 is substantially uniform through an initial length L1 of the formed end 22. The formed end 22 smoothly transitions to the cylindrical body 24 of the extension pile segment with a smooth, radiused bend 26. The inner diameter ID5 of the lead pile may be equal to the inner diameter ID1 of the body 24 of the extension pile 20, as shown in FIGS. 2A and 2B. However, the inner diameters ID1, ID5 of the body of the extension pile 20 and the lead pile 30, respectively, are not necessarily equal to one another; for example, in some embodiments, the subsequent extension pile segments 20 may have incrementally decreasing inner diameters ID1 and outer diameters OD1, which may allow for lowering the costs of the materials for the installed piling while providing the required resistance to lateral, tension and compression forces.

When coupling an extension pile segment 20 to a lead pile segment 30 that is already driven into the ground G, the exposed end 32 of the lead pile segment 30 may optionally be trimmed off, to remove any damage to the end 32 that may have been caused by the driving hammer. Then, the formed end 22 is positioned over the exposed end 32 of the lead pile segment using the pile rig, and then a driving force is applied to the opposite, driven end (not shown) of the extension pile segment 20 in direction A. When the driving force is applied in direction A to the extension pile segment 20, the exposed end 32 of the lead pile segment is pushed further into the formed end 22 of the lead pile segment 20, thereby causing further radial deformation of the extension pile segment 20 through secondary end forming as the lead pile end 32 progresses axially into the body of extension pile 20, this process referred to herein as "secondary end forming." Secondary end forming, when it occurs, increases the initial length L1 of the formed end 22, for example by a further distance of approximately, but not limited to, a distance of six to twelve inches (15 cm to 30 cm), to arrive at a final length L2 of the formed end 22, as shown in FIG. 2B.

As the driving force A continues to be applied to the driven end of the extension pile segment 20, both the lead and extension pile segments 30, 20 are driven further into the ground G while at the same time providing for tighter coupling of the segments 20, 30 as the exposed end 32 of the lead pile segment 30 moves farther into the extension pile segment 20. Advantageously, in some embodiments by orienting the extension pile segment so that the formed end 22 is at the bottom of the segment and fitted over the exposed end 32 of the lead pile segment, damage to the formed end by the driving hammer of the pile rig may be avoided, which damage may otherwise occur if the extension pile segment were oriented in the opposite direction with the formed end 22 in direct contact with the drive hammer.

Figure 1C:
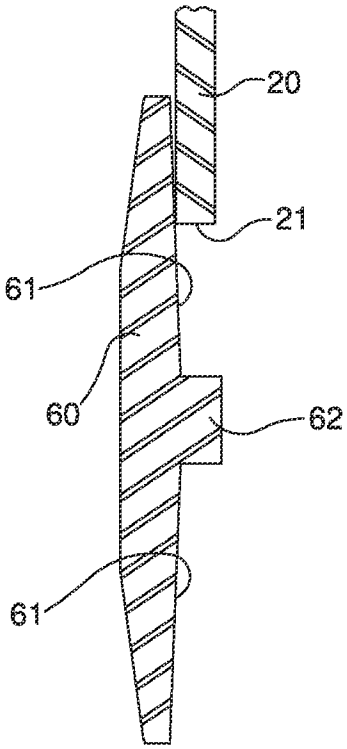
FIG.1C (PRIOR ART)
FIG. 1C is a sectional view of a prior art pile coupling comprising a drive fit splice sleeve.
Figure 1B:
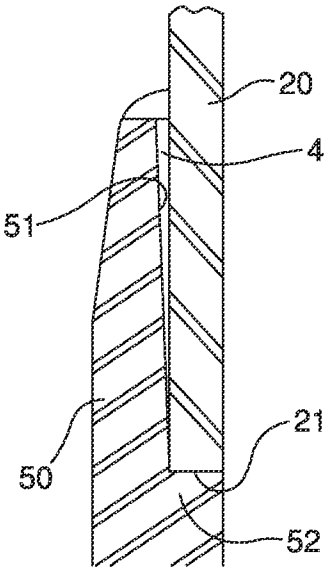
FIG.1B (PRIOR ART)
FIG. 1B is a sectional view of a prior art pile coupling comprising a welded fit splice sleeve.
Figure 1A:
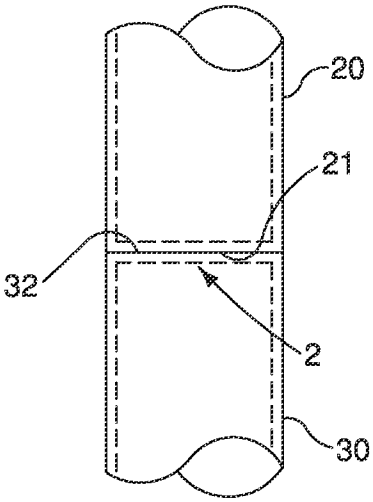
FIG.1A (PRIOR ART)
FIG. 1A is a profile view of a prior art pile coupling wherein the two pile segments are spliced together using a reinforcing backing ring.

The Applicant has found that the secondary end forming process, whereby the initial length L1 of the formed end 22 is increased to reach a final length L2, provides for a stronger coupling with increased frictional resistance to compressive, lateral and tension loads, as compared to other prior art coupling methods. With this increased frictional resistance, the extension pile segment 20 resists being pulled upwardly in direction B, bending laterally, or compressing downwardly in direction A. The Applicant has found that optionally applying a fillet weld 34, at the junction between the lead pile segment 30 and the extension pile segment 20, may provide additionally increased resistance to tension forces applied to the extended pile in direction B. Preferably, the fillet weld 34 (which is only shown on one side of the diagram in FIG. 2A, for clarity) would be applied before driving the extended pile, such that the exposed end 32 is no longer moving further into the extension pile segment 20. Thus, in such embodiments where a fillet weld 34 is applied to the coupling 10, no secondary end forming would occur, and the formed end serves the function of fitting over the exposed end 32 of the lead segment. Although the optional installation method of applying a fillet weld 34 involves field welding, the Applicant finds such field welding is minimal as compared to other coupling methods known in the art. Furthermore, applying fillet weld 34 avoids the cost of requiring a pre-manufactured coupling sleeve added to the pile segments, as is known in the prior art and shown, for example in FIGS. 1B and 1C.

In other embodiments, such as shown in FIGS. 3A to 4C, the extension pile segment 20 further comprises an external ring portion 40. In the illustrated embodiments, the external ring portion 40 comprises a metal ring 42 having an inner diameter ID3 that is approximately equal to an outer diameter OD1 of the body 24 of the extension pile segment 20, and an outer diameter OD3. In other words, in some embodiments the external ring portion 40 comprises a metal ring 42 that is sized to snugly fit over the body 24 of the extension pile segment 20. The outer diameter OD5 of the lead pile segment 30 may also be substantially equal to the outer diameter OD1 of the body 24 of the extension pile segment 20. The metal ring 42, in some embodiments, may be fillet welded to the exterior surface 24*a* of the body 24, preferably with fillet welds 44 on opposite sides of the metal ring 42.

Figure 3A:
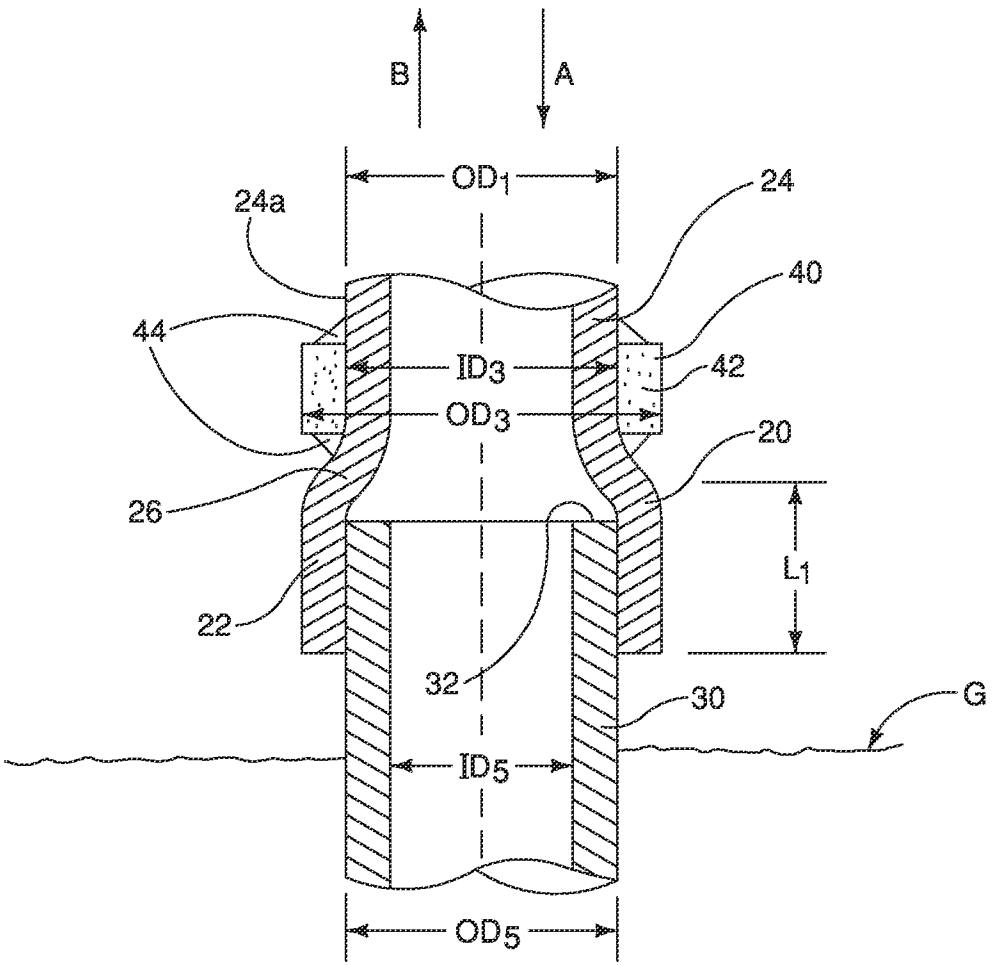
FIG. 3A is a sectional view of a further embodiment of a pile coupling, wherein an extension pile segment includes a formed end and an external ring portion positioned upstream of, and adjacent to, the formed end.
Figure 3B:
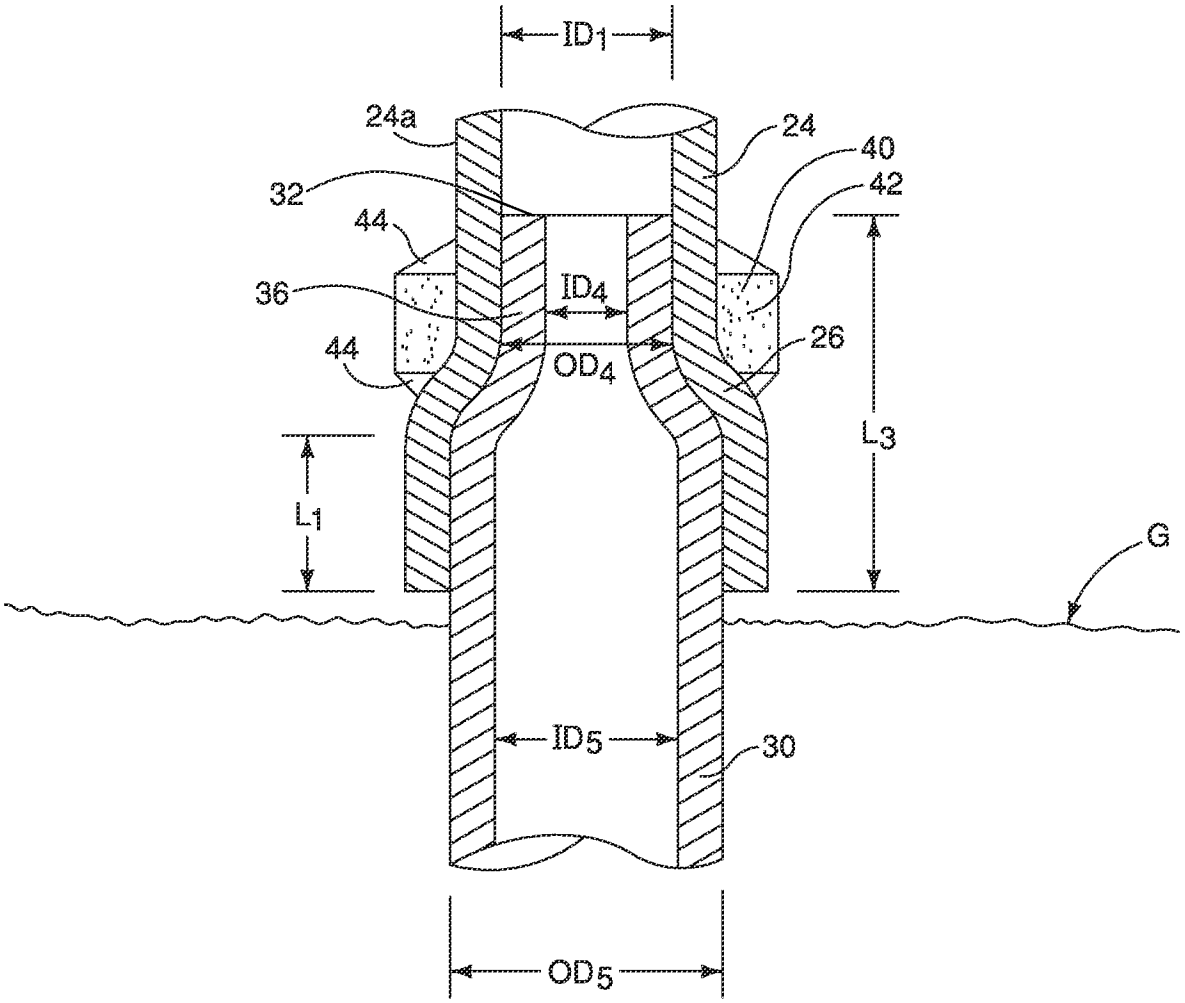
FIG. 3B is a sectional view of the embodiment of a pile coupling illustrated in FIG. 3A, where application of a driving force to the extension pile segment has resulted in extrusion of the lead pile segment through the external ring portion of the extension pile segment.

In the embodiment illustrated in FIGS. 3A and 3B, the external ring portion 40 is positioned upstream of, and adjacent to, the smooth radiused bend 26 of the extension pile segment 20. As shown in FIG. 3A, the ring portion 40 may be positioned adjacent to, so as to abut against, the radiused bend 26 that transitions into the formed end 22. When the formed end 22 is fitted over the exposed end 32 of the lead pile 30, and a driving force is applied in direction A to a driven end (not shown) of the extension pile segment 20, the extension pile segment 20 will travel downwards in direction A and the lead pile segment 30 will at the same time be pushed further inside the formed end 22, until the exposed end 32 of the lead pile segment 30 comes up against the smooth radiused bend 26 of the formed end 22, abutting against the external ring portion 40.

Once the exposed end 32 abuts against the external ring portion 40, secondary end forming is prevented by the external ring portion 40 because the external ring portion 40 prevents radial deformation of the cylindrical body 24 of the extension pile segment 20. In such an embodiment, the initial length L1 of the formed end 22 remains constant, as the secondary end forming process is prevented up to a threshold driving force applied by the piling rig hammer. If the driving force is increased beyond that threshold, the exposed end 32 of the lead pile segment 30 will begin to extrude through the inner diameter ID1 of extension pile segment 20, as shown in FIG. 3B. The resulting extruded portion 36 of the exposed end 32 of the lead pile segment 30 has an inner diameter ID4, and an outer diameter OD4 that is approximately equal to the inner diameter ID1 of the body 24 of the extension pile segment 20. Furthermore, a final length L3 of the coupling 10 is greater than the initial length L1 of the formed end 22 of the extension pile segment 20. Applicant has discovered that this extrusion action greatly increases the friction resistance between the inner wall of extension segment 20 and the outer wall of lead segment 30, providing a further increase in the resistance of the coupling 10 to compressive, lateral (bending moment) and tension loads applied to the installed pile.

Figure 4B:
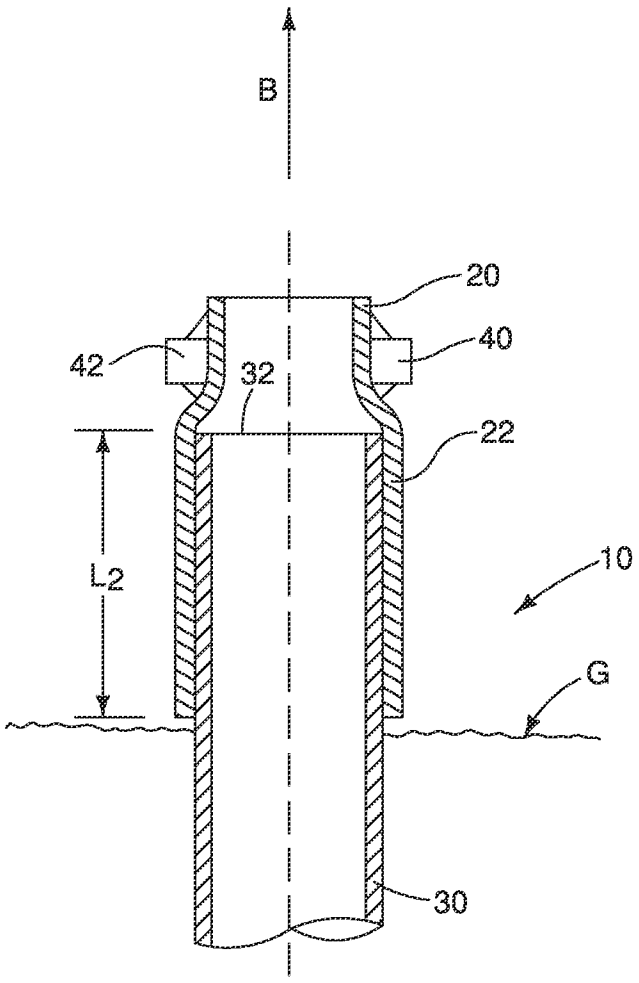
FIG. 4B is a sectional view of the embodiment of a pile coupling illustrated in FIG. 4A, where application of a driving force to the extension pile segment has resulted in secondary end forming of the extension pile segment.
Figure 4A:
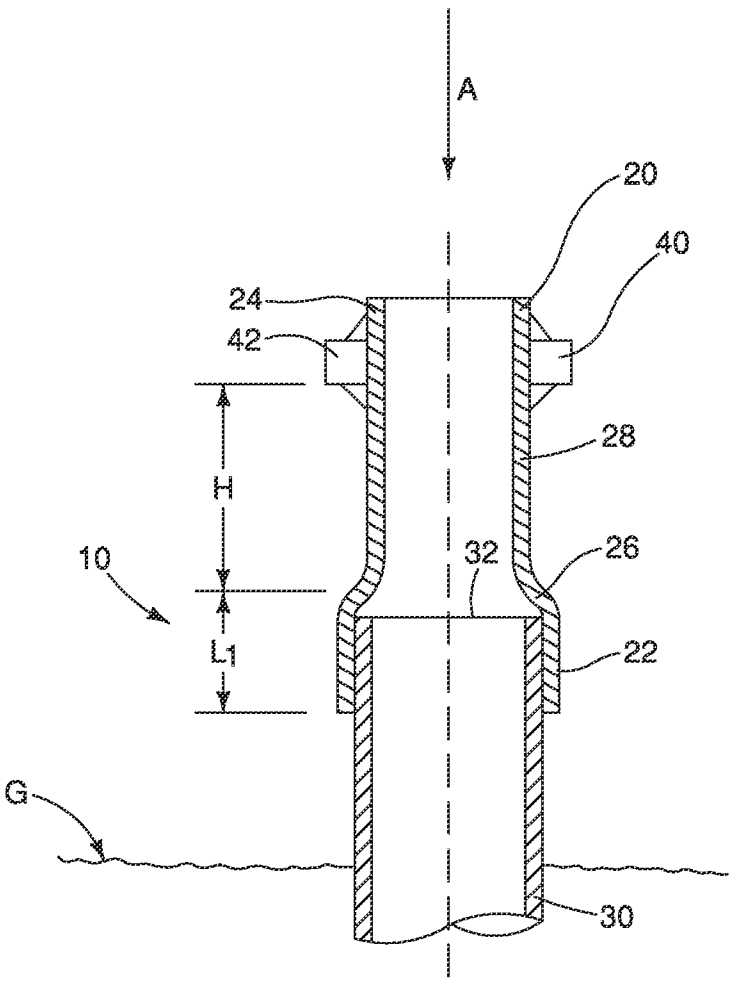
FIG. 4A is a sectional view of a further embodiment of a pile coupling, wherein an extension pile segment includes a formed end and an external ring portion positioned upstream of, and spaced apart from, the formed end.
Figure 4C:
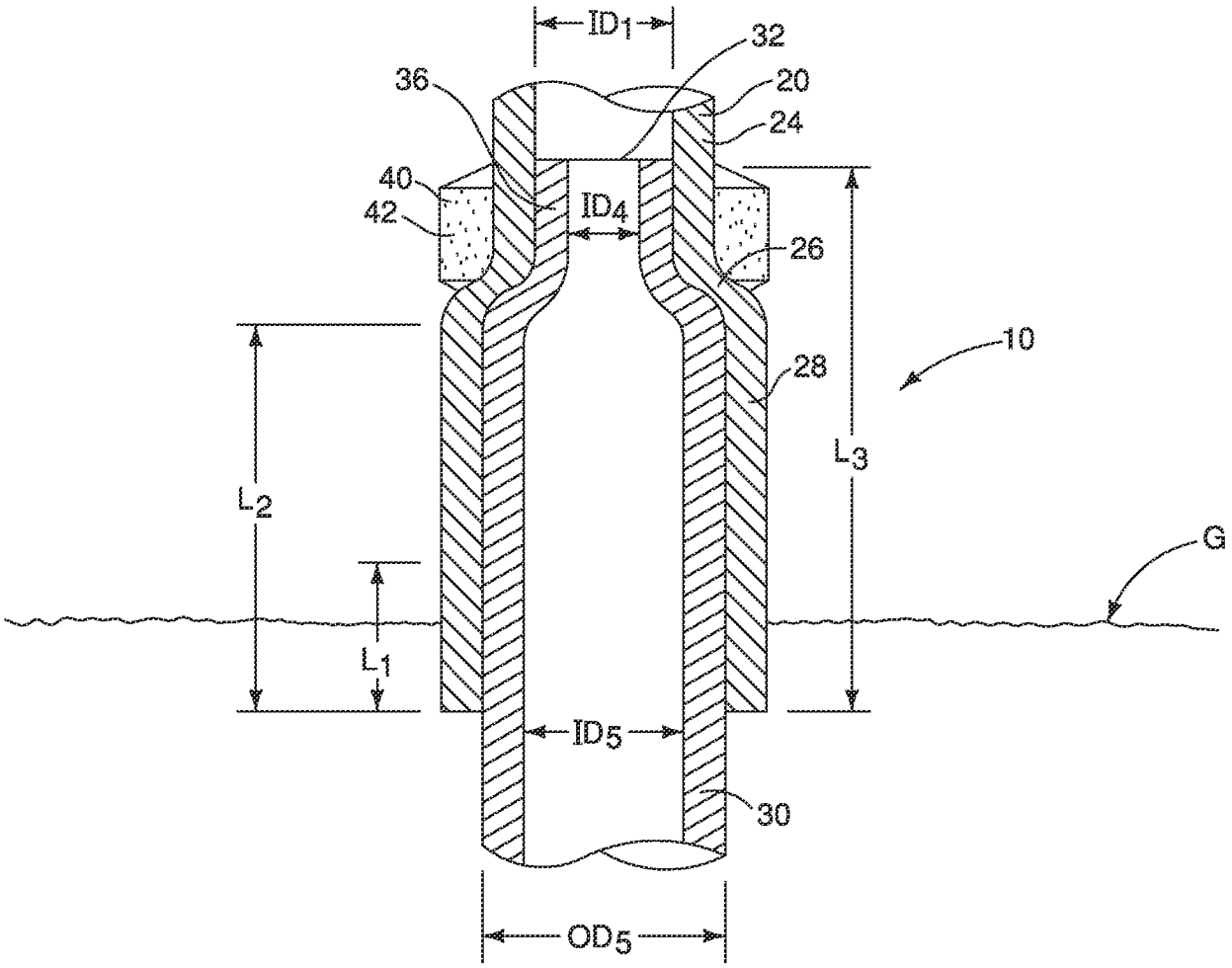
FIG. 4C is a sectional view of the embodiment of a pile coupling illustrated in FIG. 4A, where further application of a driving force to the extension pile segment has resulted in extrusion of the lead pile segment through the external ring portion of the extension pile segment.

In a further embodiment of the coupling 10, such as illustrated in FIGS. 4A to 4C, the external ring portion 40 may be spaced apart from, and positioned upstream of, the smooth radiused bend 26 of the formed end 22 of the extension pile segment 20. This arrangement of the extension pile segment 20 allows for a controlled amount of secondary end forming to occur, as determined by the distance H between the smooth radiused bend 26 of formed end 22 and the external ring portion 40, thereby controlling the final length L2 of the formed end 22. As shown in FIG. 4A, the formed end 22 has an initial length L1, prior to applying a driving force to the extension pile segment 20. To install the extension pile segment 20 onto a lead pile segment 30, the formed end 22 is placed over the exposed end 32 of the lead pile segment 30. Then, the piling rig hammer applies a driving force, in direction A, to a driven end (not shown) of the extension pile segment 20.

As the driving force A is applied to the driven end of the extension pile segment 20, as illustrated in FIG. 4B, the exposed end 32 of the lead pile segment is pushed further into the extension pile segment 20, thereby radially deforming the portion of the pile body 28 that extends between the external ring portion 40 to the smooth radiused bend 26 of formed end 22 of the extension pile segment 20. As the lead pile segment 30 extends further into the extension pile segment 20 in direction B, secondary end forming occurs whereby the final length L2 is greater than the initial length L1 of the formed end 22. In other words, the final length L2 of the formed end 22 is approximately equal to the initial length L1 of the formed end 22 and the distance H between the smooth radiused bend 26 of formed end 22 and the external ring portion 40. As shown in FIG. 4B, the secondary end forming process halts when the exposed end 32 of the lead pile segment 30 reaches, and abuts against, the external ring portion 40 of the extension pile segment 20. Advantageously, by selecting the distance H between the smooth radiused bend 26 of the formed end 22 and the external ring portion 40, the final length L2 of the formed end 22, produced by the secondary end forming process, may be configured for a given coupling. Controlling the amount of secondary end forming that occurs when installing the extension pile segment allows the installer to control the amount of frictional resistance that results from the secondary end forming process, thereby providing a stronger coupling between the two pile segments that has a higher resistance to compression, lateral (bending moment) and tension forces.

In the embodiments that include an external ring portion 40, as shown for example in FIGS. 3A to 4C, the Applicant has found that the exposed end 32 of the lead pile segment 30 continues to push into the extension pile segment 20 through the external ring portion 40 when a sufficient driving force is applied, whereby the exposed end 32 of lead pile segment 30 is cold extruded through the external ring portion 40. Advantageously, the Applicant has found that the cold extrusion process through the external ring portion 40, inside extension pile segment 20, provides a tighter coupling 10 and has an increased resistance to tension forces in direction B, as compared to other coupling methods described herein.

As discussed above, one method of manufacturing the external ring portion of the extension pile segment 20 includes pushing the body 24 of the extension pile segment 20 through a metal ring 42, wherein the metal ring 42 sized to snugly slide over the body 24 of the extension pile segment 20. Once the metal ring 42 is in the desired position, such as abutting against the smooth radiused bend 26 of formed end 22 or spaced apart from the smooth radius bend 26 of formed end 22 at a distance H, the metal ring 42 is fillet welded into place on either side of the ring.

It will be appreciated that other methods of manufacturing an extension pile segment having an external ring portion 40 are intended to be included in the scope of the present disclosure. For example, not intended to be limiting, in some embodiments the metal ring 42 may be secured to the exterior surface 24*a* of the body of the extension pile segment using a plurality of fasteners. In other embodiments, the external ring portion 40 may not be formed of a separate metal ring 42, but instead, may be a portion of the body 24 of the pile segment 20 that has a thicker wall, the thicker wall extending outwardly of the outer diameter OD1 of the body 24. The integrally formed external ring portion 40, in other words, may be a thickened or reinforced portion of the pile body 24, reinforced such that it resists radial deformation by secondary end forming when the extension pile segment 20 is driven in direction A on top of the lead pile segment 30. Such thickened or reinforced external ring portions 40 that are integrally formed with the cylindrical body 24 of the pile segment may be manufactured, for example, by molding the pile segment, by heating a portion of the pile body via induction heading and then pushing the opposite ends of the pile towards one another with a mandrel inside so that the outer wall of the pile body is pushed radially outwards through the heated portion, or by any other method known to a person skilled in the art.

In a preferred method of manufacturing the formed end of the extension pile segment, a segment of structural pipe having the desired outer diameter is placed in an end forming machine or device, comprising a mandrel having a diameter that exceeds the outer diameter of the structural pipe segment. The mandrel is forced into one opening of the structural pipe, which deforms and widens the opening of the structural pipe to create the formed end, wherein the inner diameter 102 of the formed end 22 is substantially equal to the outer diameter of the mandrel. The end forming process, which may be performed on an ambient temperature structural pipe (cold end forming) or on a heated structural pipe (hot end forming), is relatively quick and inexpensive, and a structural pipe made of any material suitable to the end forming process may be used. In some cases, the end of the pipe to be formed may be heated if material properties or pipe wall thickness requires heating to perform the end forming process, as would be known to a person skilled in the art. Advantageously, recycled, repurposed or left-over sections of structural pipe may be used to create the pile segments disclosed herein, which may reduce waste by using leftover portions of pipe to manufacture new pile segments. Pile segments of different lengths may be used in the methods described herein.

The embodiments of pile couplings for a driven steel pipe pile, discussed above, advantageously offer a simple and flexible system of pile couplings that may be readily configured for designing piles that meet specification for different levels of resistance to compression, lateral, and/or tension loads. As compared to other pile couplings, the different embodiments of pile couplings disclosed herein may be configured for greater resistance to, in particular, tension loads, which may pull the coupling apart when applied to the uppermost end of the pile, and lateral (bending) loads, which may cause the pile to bend, if the piles are not configured for sufficient resistance to these loads. Advantageously, the pile couplings disclosed herein are relatively inexpensive to manufacture, while offering flexibility in configuration for resistance to different loads.

For example, where no or minimal tension load resistance is required, an extension pile having a formed end may be added to the lead pile, and the driving force used to couple the pile segments together may be less than the yield strength of the formed end, whereby no secondary end forming will occur. Where no secondary end forming occurs, in such coupling embodiments, the pile will not resist uplift.

When the driving (compressive) force applied to the extension pile, having a formed end, exceeds the yield strength of the formed end, then secondary end forming will occur (as illustrated, for example, in FIGS. 2A and 2B). When secondary end forming occurs, there is increased friction between the inner wall of the formed end and the outer wall of the exposed end of the lead pile segment, thereby offering increased tension force resistance.

For embodiments in which an external ring portion is added to the extension pile segment, upstream of and spaced apart from the formed end, and the driving (compressive) force applied is adjusted such that the exposed end of the lead pile segment only pushes into the extension pile segment until it abuts against the external ring portion (via the secondary end forming process; see FIG. 4B), then this configuration of pile coupling will offer approximately the same level of tension force resistance as is offered by the pile coupling configuration described above (with secondary end forming occurring but without a external ring portion added to the extension pile segment). However, in this embodiment, the final length of the formed end of the extension pile, and therefore the extent of secondary end forming that occurs, may be configured by selecting the distance between the external ring portion and the formed end of the extension pile segment. Additionally, configuring the pile coupling to have a specified final length of the formed end (via the secondary end forming process) may also increase the pile's resistance to lateral (bending) forces.

For embodiments where the extension pile segment includes a external ring portion, and sufficient force is applied to the extension pile segment to cause the lead pile segment to extrude through the external ring portion, such pile coupling configurations offer greater resistance to tension forces, as compared to the other embodiments described above. Examples of such coupling configurations are illustrated, for example, in FIGS. 3B and 4C.

Pile couplings may also be configured by fitting a formed end of an extension pile segment over the exposed end of a lead pile segment, and applying a fillet weld to the coupling prior to applying the driving force. Although such embodiments involve some field welding, this method may be less costly than other prior art couplings due to the absence of a separate coupling sleeve device. Configurations of pile couplings involving welding offer the greatest amount of resistance to tension, lateral and compressive forces.

What is claimed is:

1. A coupling between a lead pile segment and an extension pile segment of a driven piling, the coupling comprising:

the lead pile segment;

the extension pile segment having a formed end, an opposite driven end opposite of the formed end, and a body extending therebetween, the formed end having an inner diameter that is equal to or greater than an outer diameter of an exposed end of the lead pile segment and is greater than an outer diameter of the body of the extension pile segment;

an external ring having an inner diameter sized to snugly fit over the outer diameter of the body of the extension pile segment, the external ring affixed to an exterior surface of the body of the extension pile segment and positioned upstream of the formed end;

the coupling formed by inserting the exposed end of the lead pile segment into the formed end of the extension pile segment and applying a driving force to the driven end of the extension pile segment such that the formed end of the extension pile segment undergoes secondary end forming thereby increasing an initial length of the formed end prior to coupling the extension pile segment with the lead pile segment to a final length of the formed end after the driving force is applied to the driven end to couple the extension pile segment to the lead pile segment; and wherein the exposed end of the lead pile segment is cold extruded into and through a portion of the extension pile segment adjacent to the external ring to further increase a force resistance of the coupling.

2. The coupling of claim 1, wherein the initial length of the formed end is in the range of six inches to twelve inches.

3. The coupling of claim 1, wherein the external ring has a ring length in the range of three inches to six inches.

4. The coupling of claim 1, wherein the external ring is adjacent to and abuts against the formed end of the extension pile segment.

5. The coupling of claim 1, wherein prior to coupling the extension pile segment with the lead pile segment, the external ring is spaced apart from, and upstream of, the formed end of the extension pile segment at a selected distance, and wherein when the driving force is applied to the driven end of the extension pile segment, the final length of the formed end that results from the secondary end forming process is equal to a sum of the initial length of the formed end and the selected distance between the formed end and the external ring.

6. A method of manufacturing the extension pile segment of claim 1, the method comprising:

selecting a structural pipe having a cylindrical body and an outer diameter, placing the structural pipe in an end forming machine, the end forming machine having a cylindrical mandrel with an outer diameter that is greater than the outer diameter of the cylindrical body, performing an end forming procedure on a first end of the structural pipe to obtain the formed end, the formed end having a selected length, affixing the external ring to the exterior surface of the cylindrical body.

7. The method of claim 6, wherein affixing the external ring is selected from a group consisting of: welding the external ring, and fastening the external ring with a plurality of fasteners.

8. The method of claim 6, wherein the external ring is positioned to abut against the formed end.

9. The method of claim 6, wherein the external ring is positioned spaced apart from, and upstream of, the formed end at a selected distance.

10. The method of claim 9, wherein the selected distance is in the range between six and twelve inches.

11. The method of claim 6, wherein the method includes the step of heating the first end of the structural pipe.

12. The coupling of claim 1, wherein the external ring is welded to the exterior surface of the body of the extension pile segment.

13. The coupling of claim 1, wherein the external ring is fastened to the exterior surface of the body of the extension pile segment using a plurality of fasteners.

* * * * *